US011469031B2

(12) United States Patent
Huang

(10) Patent No.: US 11,469,031 B2
(45) Date of Patent: Oct. 11, 2022

(54) VARIABLE INDUCTOR APPARATUS

(71) Applicant: Realtek Semiconductor Corporation, Hsinchu (TW)

(72) Inventor: Kai-Yi Huang, Taipei (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 500 days.

(21) Appl. No.: 16/445,505

(22) Filed: Jun. 19, 2019

(65) Prior Publication Data

US 2019/0392974 A1 Dec. 26, 2019

(30) Foreign Application Priority Data

Jun. 20, 2018 (TW) ..... 107121166

(51) Int. Cl.
*H01F 27/28* (2006.01)
*H01F 21/12* (2006.01)

(52) U.S. Cl.
CPC ..... *H01F 21/12* (2013.01); *H01F 27/28* (2013.01)

(58) Field of Classification Search
CPC ..... H01F 27/00–40; H01F 27/2804; H01F 21/00; H01F 21/12; H01F 21/125
See application file for complete search history.

(56) References Cited

U.S. PATENT DOCUMENTS 7,432,794 B2 10/2008 Mattsson
7,460,001 B2 12/2008 Jessie
8,963,674 B2 2/2015 Lee et al.
9,934,898 B2 * 4/2018 Mattsson ..... H01F 27/004
2006/0033602 A1 * 2/2006 Mattsson ..... H01F 17/0006 336/200
2006/0132274 A1 * 6/2006 Lee ..... H01F 21/12 336/200
2009/0201100 A1 * 8/2009 Kossel ..... H03H 7/185 333/138
2011/0163824 A1 * 7/2011 Kawano ..... H03F 1/565 333/17.3
2013/0140672 A1 * 6/2013 Sato ..... H01L 28/10 257/531

FOREIGN PATENT DOCUMENTS

CN 105917464 A 8/2016

* cited by examiner

*Primary Examiner* — Tuyen T Nguyen
(74) *Attorney, Agent, or Firm* — Locke Lord LLP; Tim Tingkang Xia, Esq.

(57) ABSTRACT

An apparatus is provided that includes an inductor, a pair of modulating coils, a first switch and a second switch. The inductor includes two sub-loops electrically coupled with each other. The modulating coils include a first modulating coil and a second modulating coil respectively disposed corresponding to each of the two sub-loops. The first switch and the second switch are respectively disposed at the first modulating coil and the second modulating coil. Each of the first modulating coil and the second modulating coil forms an open loop when the first switch and the second switch are under an open status, and each of the first modulating coil and the second modulating coil forms a closed loop when the first switch and the second switch are under a closed status that enables a modulation of an inductance of the inductor.

20 Claims, 5 Drawing Sheets

VARIABLE INDUCTOR APPARATUS

RELATED APPLICATIONS

This application claims priority to Taiwan Application Serial Number 107121166, filed Jun. 20, 2018, which is herein incorporated by reference.

BACKGROUND

Field of Invention

The present invention relates to an inductor technology. More particularly, the present invention relates to a variable inductor apparatus.

Description of Related Art

An inductor is an electric component that generates electromotive force due to the electric current passing therethrough to resist the change of the electric current. In current integrated circuit design, circuits operating in a multiple frequency bands are integrated in a single chip. Variable inductors are required to be used to address the issue of magnetic coupling among the circuits operating in different frequency bands. However, the current design of variable inductors often degrades the Q factor of the whole inductor due to the existence of the modulating circuits.

Accordingly, what is needed is a variable inductor apparatus to address the issues mentioned above.

SUMMARY

An aspect of the present invention is to provide an apparatus that includes an inductor, a pair of modulating coils and a first switch and a second switch. The 8-shaped inductor includes two sub-loops electrically coupled with each other. The pair of modulating coils include a first modulating coil and a second modulating coil disposed corresponding to each of the sub-loops respectively. The first switch and the second switch are disposed at the first modulating coil and the second modulating coil respectively, wherein each of the first modulating coil and the second modulating coil forms an open loop when the first switch and the second switch are under an open status, and each of the first modulating coil and the second modulating coil forms a closed loop when the first switch and the second switch are under a closed status that enables a modulation of an inductance of the inductor.

These and other features, aspects, and advantages of the present invention will become better understood with reference to the following description and appended claims.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
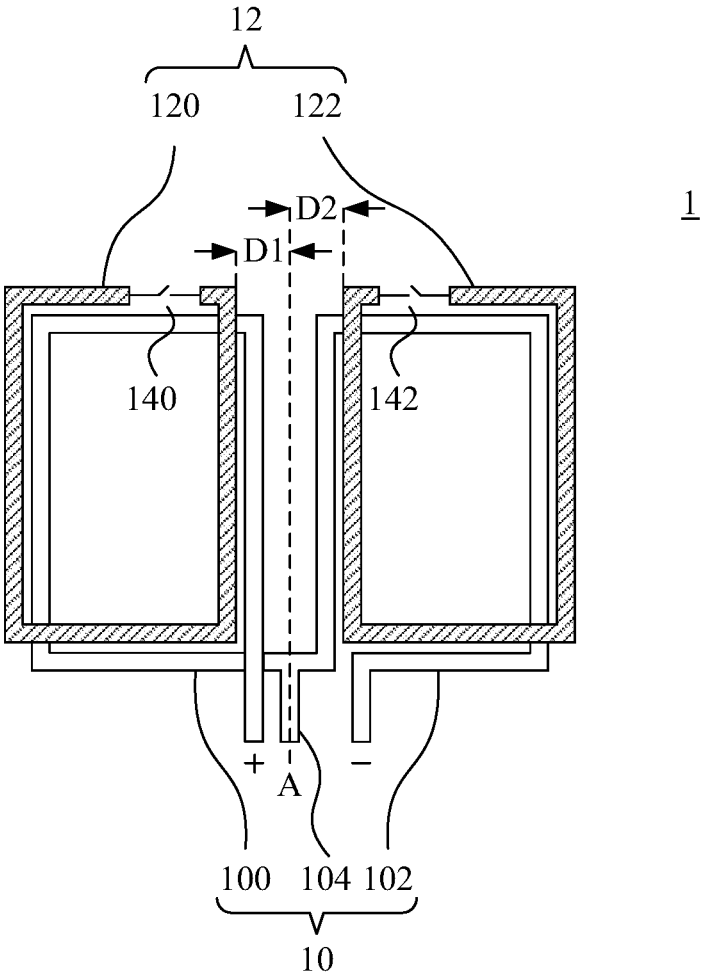
FIG. 1 is a block diagram of a variable inductor apparatus in an embodiment of the present invention.

Reference is now made to FIG. 1. FIG. 1 is a block diagram of a variable inductor apparatus 1 in an embodiment of the present invention. The variable inductor apparatus 1 includes an 8-shaped inductor 10, a pair of modulating coils 12, a first switch 140 and the second switch 142.

The 8-shaped inductor 10 includes two sub-loops 100 and 102 electrically coupled to each other. A terminal of the sub-loop 100 is electrically coupled to the sub-loop 102, while the other terminal of the sub-loop 100 is electrically coupled to a positive terminal (illustrated as a symbol '+' in FIG. 1). A terminal of the sub-loop 102 is electrically coupled to the sub-loop 1002, while the other terminal of the sub-loop 102 is electrically coupled to a negative terminal (illustrated as a symbol '−' in FIG. 1).

In an embodiment, the 8-shaped inductor 10 further includes a central tap 104. The central tap 104 is formed on one of the sub-loop 100 and sub-loop 102. In FIG. 1, the central tap 104 is exemplarily illustrated on the sub-loop 100. In the present embodiment, an extended axis A of the central tap 104 is extended between the sub-loop 100 and the sub-loop 102.

The pair of the modulating coils 12 include a first modulating coil 120 and a second modulating coil 122. The first modulating coil 120 and the second modulating coil 122 are disposed above each of the sub-loop 100 and the sub-loop 102 respectively. In the present embodiment, the first modulating coil 120 is disposed on top of the sub-loop 100. The second modulating coil 122 is disposed on top of the sub-loop 102.

It is appreciated that the position of the first modulating coil 120 and the second modulating coil 122 relative to the sub-loop 100 and the sub-loop 102 is not limited to the one as illustrated in FIG. 1. In other embodiments, the first modulating coil 120 and the second modulating coil 122 may be formed, for example, below the sub-loop 100 and the sub-loop 102, and is thus not limited to the position illustrated in FIG. 1.

The first switch 140 and the second switch 142 are disposed at the first modulating coil 120 and the second modulating coil 122 respectively. The first switch 140 and the second switch 142 can be operated under an open status and a closed status.

Figure 2A:
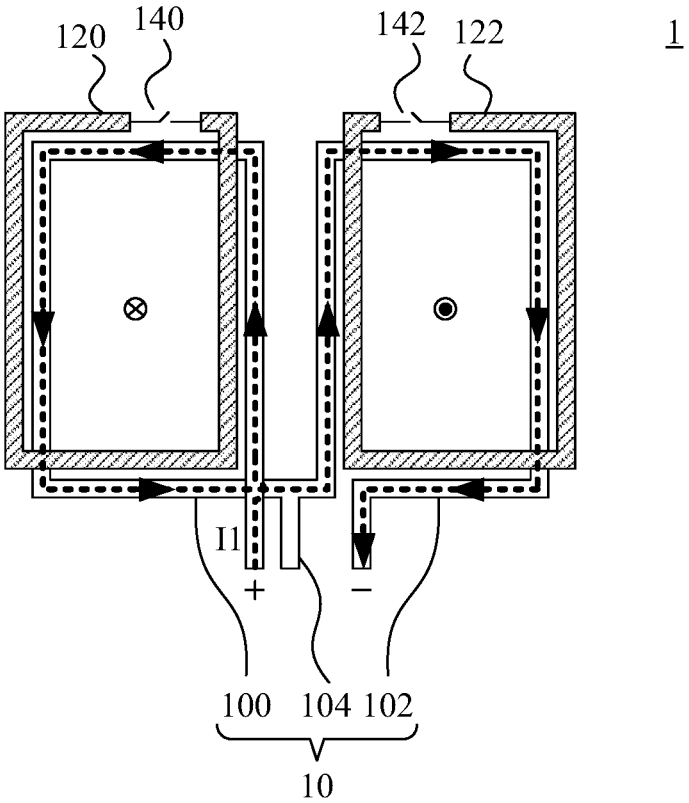
FIG. 2A is a diagram of the variable inductor apparatus when the first switch and the second switch are under the open status in an embodiment of the present invention.
Figure 2B:
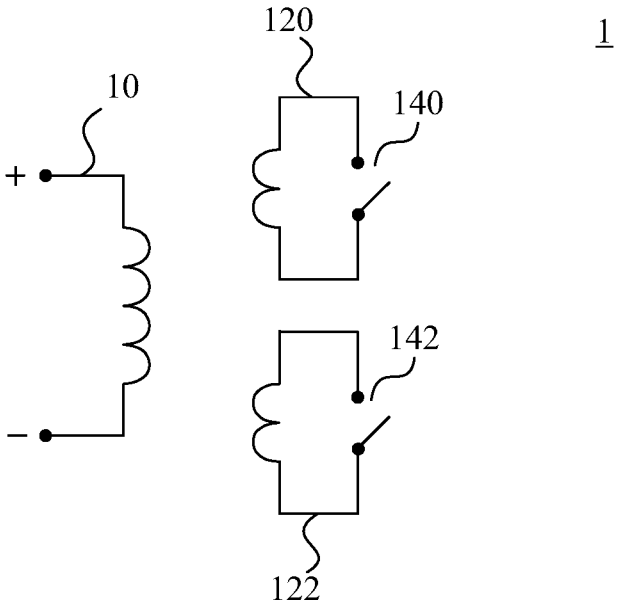
FIG. 2B is an equivalent circuit diagram of the variable inductor apparatus when the first switch and the second switch are under the open status in an embodiment of the present invention.

Reference is now made to FIG. 2A and FIG. 2B. FIG. 2A is a diagram of the variable inductor apparatus 1 when the first switch 140 and the second switch 142 are under the open status in an embodiment of the present invention. FIG. 2B is an equivalent circuit diagram of the variable inductor apparatus 1 when the first switch 140 and the second switch 142 are under the open status in an embodiment of the present invention.

In an embodiment, the current directions of the currents in the sub-loop 100 and the sub-loop 102 of the 8-shaped inductor 10 are opposite. As a result, the directions of the magnetic fields formed therefrom are opposite as well. For example, the current 11 flows into the positive terminal, forwards along the sub-loop 100 with a counter clockwise direction, forwards along the sub-loop 102 with a clockwise direction and flows out of the positive terminal. Under such a condition, the current 11 forms a magnetic field having a direction pointing out of the plane of the paper in the sub-loop 100 and forms a magnetic field having a direction pointing into the plane of the paper in the sub-loop 102.

As illustrated in FIG. 2A and FIG. 2B, when the current 11 flows through the sub-loop 100 of the 8-shaped inductor 10 and when the first switch 140 is under the open status, the first modulating coil 120 forms an open loop. More specifically, the first modulating coil 120 is not able to form a complete loop. The magnetic field can not be generated since the current can not flow through the first modulating coil 120. As a result, the first modulating coil 120 does not affect the sub-loop 100.

Similarly, when the second switch 142 is under the open status, the second modulating coil 122 forms an open loop. More specifically, the second modulating coil 122 is not able to form a complete loop. The magnetic field can not be generated since the current can not flow through the second modulating coil 122. As a result, the second modulating coil 122 does not affect the sub-loop 102.

Figure 3A:
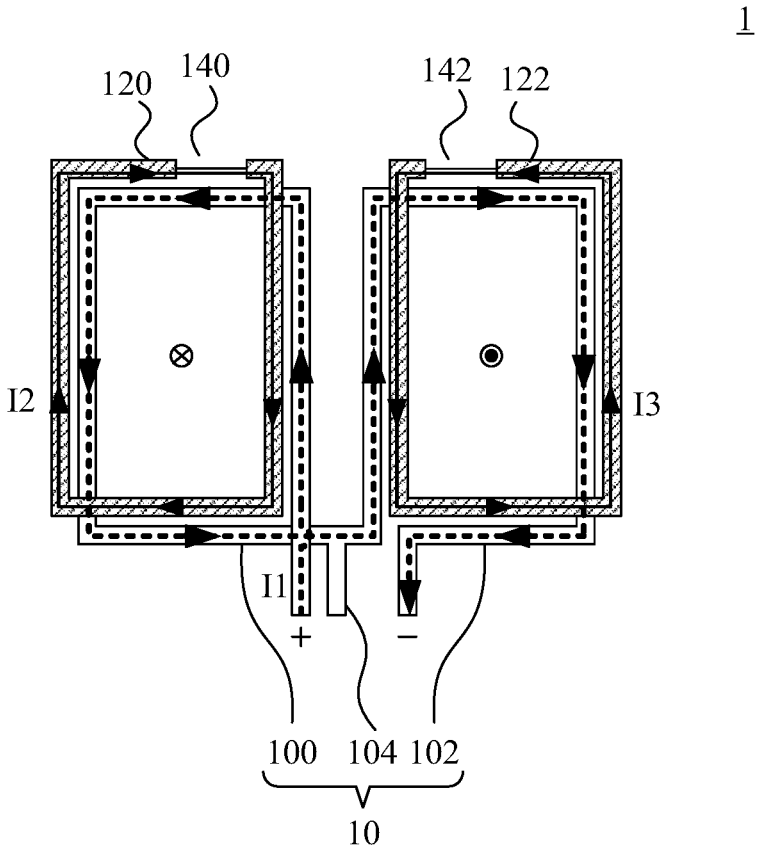
FIG. 3A is a diagram of the variable inductor apparatus when the first switch and the second switch are under the closed status in an embodiment of the present invention.
Figure 3B:
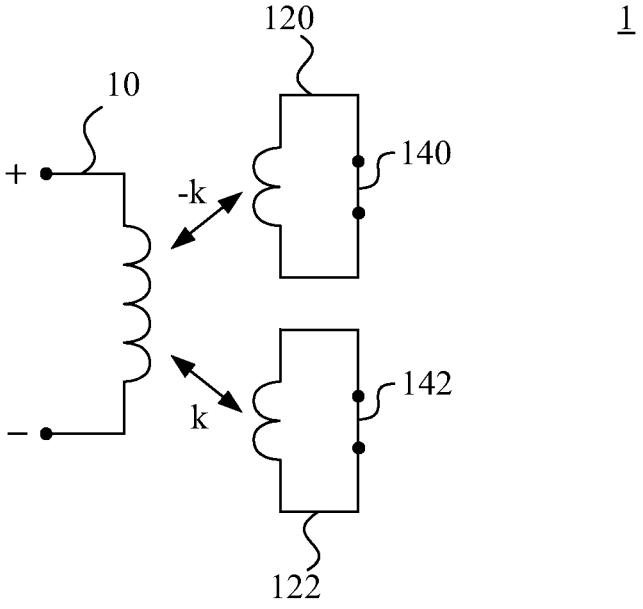
FIG. 3B is an equivalent circuit diagram of the variable inductor apparatus when the first switch and the second switch are under the closed status in an embodiment of the present invention.

Reference is now made to FIG. 3A and FIG. 3B. FIG. 3A is a diagram of the variable inductor apparatus 1 when the first switch 140 and the second switch 142 are under the closed status in an embodiment of the present invention. FIG. 3B is an equivalent circuit diagram of the variable inductor apparatus 1 when the first switch 140 and the second switch 142 are under the closed status in an embodiment of the present invention.

As illustrated in FIG. 3A and FIG. 3B, when the current 11 flows through the sub-loop 100 of the 8-shaped inductor 10 and when the first switch 140 is under the closed status, the first modulating coil 120 forms a closed loop. More specifically, the first modulating coil 120 is able to form a complete loop due to the operation of the first switch 140. The magnetic field can be generated since the current is able to flow through the first modulating coil 120. According to the current 11 of the sub-loop 100, an induced current 12 is generated by the first modulating coil 120 due to the mutual inductance.

In an embodiment, the coupling coefficient between the 8-shaped inductor 10 and the first modulating coil 120 is −k, while k is related to the size of the 8-shaped inductor 10 and the first modulating coil 120, and to the distance between the 8-shaped inductor 10 and the first modulating coil 120.

Similarly, when the second switch 142 is under the closed status, the second modulating coil 122 forms a closed loop. More specifically, the second modulating coil 122 is able to form a complete loop due to the operation of the second switch 142. The magnetic field can be generated since the current can flow through the second modulating coil 122. According to the current 11 of the sub-loop 102, an induced current 13 is generated by the second modulating coil 122 due to the mutual inductance.

In an embodiment, the coupling coefficient between the 8-shaped inductor 10 and the second modulating coil 122 is k, while k is related to the size of the 8-shaped inductor 10 and the second modulating coil 122, and to the distance between the 8-shaped inductor 10 and the second modulating coil 122.

As a result, when the first switch 140 and the second switch 142 are under the closed status, the first modulating coil 120 and the second modulating coil 122 can generate magnetic fields according to the induced currents 12 and 13 to further modulate the inductance of the sub-loops 100 and 102. More specifically, the first modulating coil 120 and the second modulating coil 122 can modulate the inductance of the 8-shaped inductor 10 according to the operation of the first switch 140 and the second switch 142.

In an embodiment, a position, a shape and a size of the first modulating coil 120 and the second modulating coil 122 are symmetric with respect to the extended axis A of the central tap 104. For example, the distances D1 and D2 (labeled in FIG. 1) of the first modulating coil 120 and second modulating coil 122 with respect to the central tap 104 are the same. The shapes of the first modulating coil 120 and second modulating coil 122 are the same. The sizes of the first modulating coil 120 and second modulating coil 122 are substantially the same. Further, the first switch 140 and the second switch 142 are together under either the open status or the closed status to accomplish a symmetrically and differentially inductive characteristic.

More specifically, if the open status is represented by 0 and the closed status is represented by 1, the first switch 140 and the second switch 142 are operated under either (0, 0) or (1, 1) to accomplish the symmetrically and differentially inductive characteristic.

It is appreciated that the position, the shape and the size of the first modulating coil 120 and the second modulating coil 122 in the embodiments described above are merely an example. In other embodiments, the position, the shape and the size of the first modulating coil 120 and the second modulating coil 122 can be different based on the actual requirement and are not limited thereto.

As a result, the variable inductor apparatus 1 of the present invention can perform modulation on the inductance of the 8-shaped inductor 10 when the first switch 140 and the second switch 142 are under the closed status such that the inductance is variable. When the first switch 140 and the second switch 142 are under the open status, the first modulating coil 120 and the second modulating coil 122 can become open loops without affecting the operation of the 8-shaped inductor 10.

Figure 4:
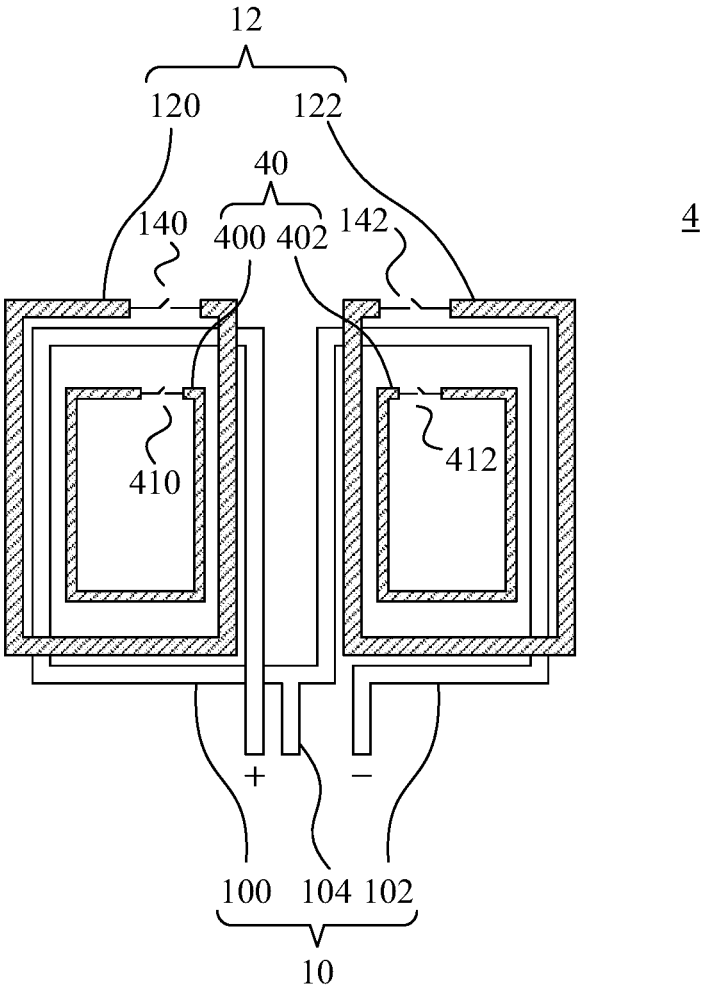
FIG. 4 is a diagram of a variable inductor apparatus in an embodiment of the present invention.

Reference is now made to FIG. 4. FIG. 4 is a diagram of a variable inductor apparatus 4 in an embodiment of the present invention.

Similar to the variable inductor apparatus 1 in FIG. 1, the variable inductor apparatus 4 includes an 8-shaped inductor 10, a pair of modulating coils 12, a first switch 140 and a second switch 142. However, in the present embodiment, the variable inductor apparatus 4 further includes a pair of modulating coils 40, a third switch 410 and a fourth switch 412.

Similar to the modulating coils 12, the modulating coils 40 include a third modulating coil 400 and a fourth modulating coil 402. The third switch 410 and the fourth switch 412 are disposed at the third modulating coil 400 and the fourth modulating coil 402 respectively and the operation of the third switch 410 and the fourth switch 412 is identical to the operation of the first switch 140 and the second switch 142. The detail is not described herein.

Since the variable inductor apparatus 4 includes a plurality pairs of the modulating coils 12 and 40, the modulation of the inductance of the 8-shaped inductor 10 can be more dynamic. The size of the modulating coils 40 can be either the same as the size of the modulating coils 12 or different from the size of the modulating coils 12. In the present embodiment, the size of the modulating coils 40 is illustrated to be smaller than the size of the modulating coils 12.

In an embodiment, similar to the operation of the first switch 140 and the second switch 142, the third switch 410 and the fourth switch 412 are required to be together under either the open status or the closed status to accomplish a symmetrically and differentially inductive characteristic.

Figure 5:
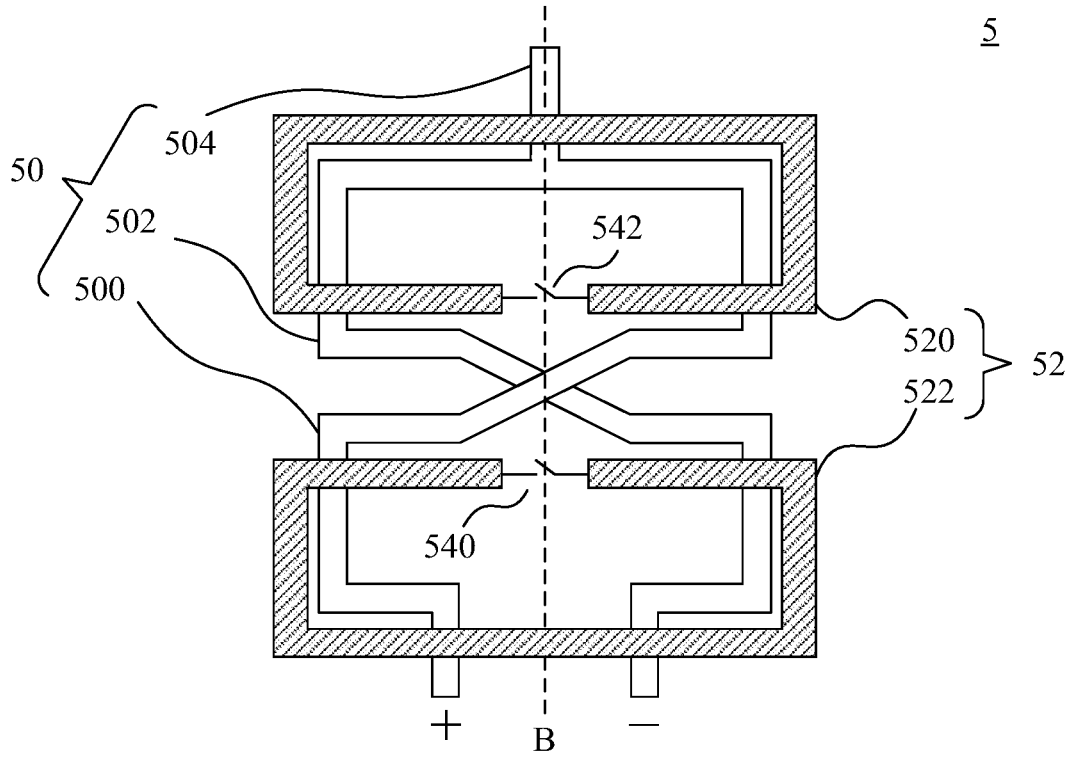
FIG. 5 is a diagram of a variable inductor apparatus in an embodiment of the present invention.

Reference is now made to FIG. 5. FIG. 5 is a diagram of a variable inductor apparatus 5 in an embodiment of the present invention.

The variable inductor apparatus 5 includes an 8-shaped inductor 50, a pair of modulating coils 52, a first switch 540 and a second switch 542.

The 8-shaped inductor 50 includes two sub-loops 500 and 502 electrically coupled to each other. The sub-loop 500 includes four terminals. Two terminals at one side are electrically coupled to a positive terminal (illustrated as a symbol '+' in FIG. 5) and a negative terminal (illustrated as a symbol '−' in FIG. 5) respectively. The other two terminals at the other side are electrically coupled to two terminals of the sub-loop 502.

In an embodiment, the 8-shaped inductor 50 further includes a central tap 504. The central tap 504 is formed on one of the sub-loop 500 and the sub-loop 502. In FIG. 5, the central tap 504 is exemplarily illustrated on the sub-loop 502. In the present embodiment, an extended axis B of the central tap 504 traverses the sub-loop 500 and the sub-loop 502.

The pair of modulating coils 52 include a first modulating coil 520 and a second modulating coil 522 disposed on the top of one of the sub-loop 500 and the sub-loop 502 respectively. In the present embodiment, the first modulating coil 520 is disposed on the top of the sub-loop 500, while the second modulating coil 522 is disposed on the top of the sub-loop 502.

In the present embodiment, two sides of the first modulating coil 520 with respect to the extended axis B are symmetric. Two sides of the second modulating coil 522 with respect to the extended axis B are symmetric.

The first switch 540 and the second switch 542 are disposed at the first modulating coil 520 and the second modulating coil 522 respectively. The first switch 540 and the second switch 542 can be under an open status and a closed status.

Similar to the first switch 140 and the second switch 142 in FIG. 1, the first modulating coil 520 and the second modulating coil 522 can form an open loop and a closed loop alternatively due to the open status and the closed status of the first switch 540 and the second switch 542 in the present embodiment.

It is appreciated that in the present embodiment, since the two sides of each of the first modulating coil 520 and second modulating coil 522 are symmetric with respect to the extended axis A, the symmetrically and differentially inductive characteristic of each of the first modulating coil 520 and the second modulating coil 522 can be maintained even if the first switch 540 and the second switch 542 operate independently.

More specifically, if the open status is represented by 0 and the closed status is represented by 1, the first switch 540 and the second switch 542 can be operated under four status including (0, 0), (0, 1), (1, 0) and (1, 1). The modulation of the inductance of the 8-shaped inductor 50 can be more elastic.

Figure 6:
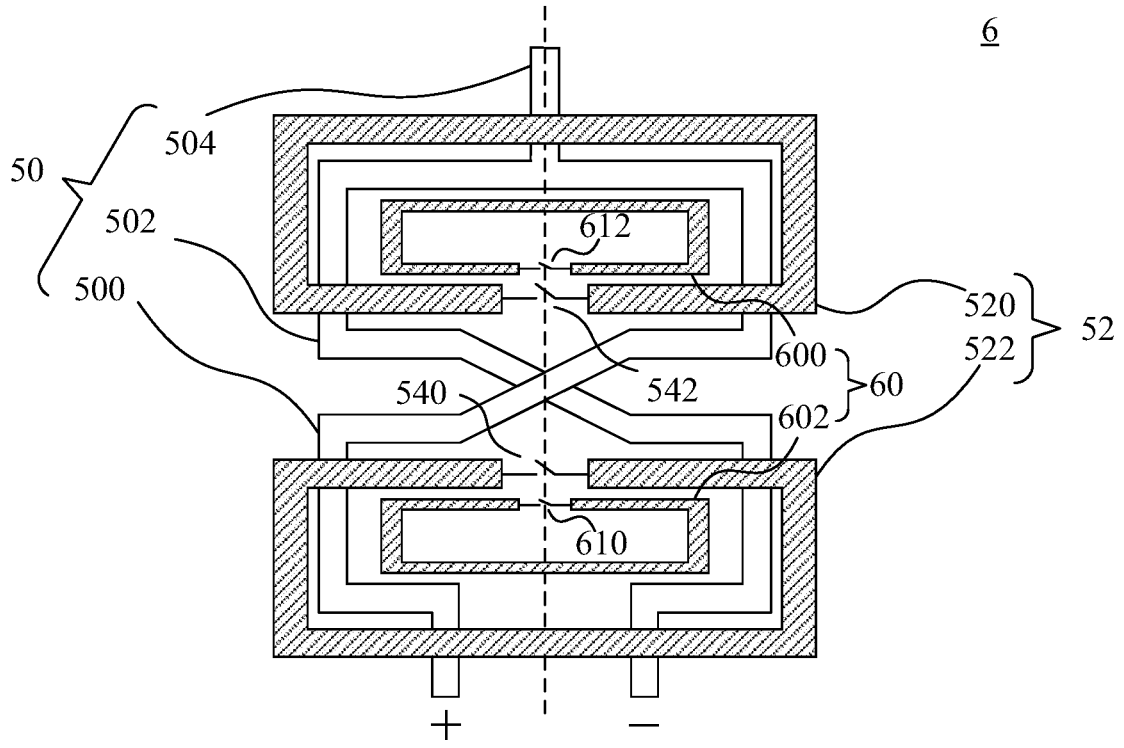
FIG. 6 is a diagram of a variable inductor apparatus in an embodiment of the present invention.

Reference is now made to FIG. 6. FIG. 6 is a diagram of a variable inductor apparatus 6 in an embodiment of the present invention. Similar to the variable inductor apparatus 5 illustrated in FIG. 5, the variable inductor apparatus 6 includes an 8-shaped inductor 50, a pair of modulating coils 52, a first switch 540 and a second switch 542. However, in the present embodiment, the variable inductor apparatus 6 further includes a pair of modulating coils 60, a third switch 610 and a fourth switch 612.

Similar to the modulating coils 52, the modulating coils 60 include a third modulating coil 600 and a fourth modulating coil 602. The third switch 610 and the fourth switch 612 are disposed at the third modulating coil 600 and the fourth modulating coil 602 respectively and the operation of the third switch 610 and the fourth switch 612 is identical to the operation of the first switch 540 and the second switch 542. The detail is not described herein.

Since the variable inductor apparatus 6 includes a plurality pairs of the modulating coils 52 and 60, the modulation of the inductance of the 8-shaped inductor 50 can be more dynamic. The size of the modulating coils 60 can be either the same as the size of the modulating coils 52 or different from the size of the modulating coils 52. In the present embodiment, the size of the modulating coils 60 is illustrated to be smaller than the size of the modulating coils 52.

In an embodiment, similar to the operation of the first switch 540 and the second switch 542, the third switch 610 and the fourth switch 612 can operate under the open status or the closed status independently while the symmetrically and differentially inductive characteristic can be maintained.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. An apparatus comprising:

an inductor comprising two sub-loops electrically coupled with each other;

a pair of modulating coils comprising a first modulating coil and a second modulating coil disposed corresponding to each of the sub-loops respectively; and a first switch and a second switch disposed at the first modulating coil and the second modulating coil respectively, wherein each of the first modulating coil and the second modulating coil forms an open loop when the first switch and the second switch are under an open status, and each of the first modulating coil and the second modulating coil forms a closed loop when the first switch and the second switch are under a closed status that enables a modulation of an inductance of the inductor, wherein the first modulating coil and the second modulating coil are separated from each other.

2. The apparatus of claim 1, wherein the inductor further comprises a central tap disposed on one of the two sub-loops and an extended axis of the central tap is extended between the two sub-loops such that a position, a shape and a size of the first modulating coil and the second modulating coil are symmetric with respect to the extended axis.

3. The apparatus of claim 2, wherein the first switch and the second switch are together under either the open status or the closed status.

4. The apparatus of claim 2, further comprising more of the modulating coils than the pairs of the modulating coils.

5. The apparatus of claim 4, wherein the size of each of the modulating coils is either the same or different from each other.

6. The apparatus of claim 1, wherein the 8-shaped inductor further comprises a central tap disposed on one of the two sub-loops and an extended axis of the central tap traverses the two sub-loops such that two sides of each of the first modulating coil and the second modulating coil with respect to the extended axis are symmetric.

7. The apparatus of claim 6, wherein the first switch and the second switch are together under either the open status or the closed status, or one of the first switch and the second switch is under the open status while the other one of the first switch and the second switch is under the closed status.

8. The apparatus of claim 6, further comprising more of the modulating coils than the pairs of the modulating coils.

9. The apparatus of claim 8, wherein the size of each of the modulating coils is either the same or different from each other.

10. The apparatus of claim 1, wherein a shape and a size of each of the first modulating coil and the second modulating coil are close to the two sub-loops.

11. The apparatus of claim 1, wherein the inductor is an 8-shaped inductor.

12. An apparatus comprising:

an inductor comprising a first sub-loop and a second sub-loop;

a first modulating coil disposed above the first sub-loop;

a first switch disposed at the first modulating coil, a first terminal of the first switch coupled to a first terminal of the first modulating coil, a second terminal of the first switch coupled to a second terminal of the first modulating coil;

a second modulating coil disposed above the second sub-loop; and a second switch different from the first switch, the second switch disposed at the second modulating coil, a first terminal of the second switch coupled to a first terminal of the second modulating coil, a second terminal of the second switch coupled to a second terminal of the second modulating coil.

13. The apparatus of claim 12, wherein the first sub-loop and the second sub-loop are electrically coupled with each other, and the first modulating coil and the second modulating coil are electrically isolated from each other.

14. The apparatus of claim 12, wherein the inductor further comprises:

a central tap disposed on one of the first sub-loop and the second sub-loop, wherein a distance between the central tap and the first modulating coil is same as a distance between the central tap and the second modulating coil.

15. The apparatus of claim 12, further comprising:

a third modulating coil disposed above the first sub-loop, and separated from the first modulating coil; and a fourth modulating coil disposed above the second sub-loop, and separated from the second modulating coil.

16. The apparatus of claim 15, further comprising:

a third switch disposed at the third modulating coil, a first terminal of the third switch coupled to a first terminal of the third modulating coil, a second terminal of the third switch coupled to a second terminal of the third modulating coil; and a fourth switch disposed at the fourth modulating coil, a first terminal of the fourth switch coupled to a first terminal of the fourth modulating coil, a second terminal of the fourth switch coupled to a second terminal of the fourth modulating coil.

17. A method comprising:

disposing a first modulating coil above a first sub-loop of an inductor;

disposing a second modulating coil, which is electrically isolated from the first modulating coil, above a second sub-loop of the inductor;

coupling a first terminal of the first sub-loop to a first terminal of the second sub-loop;

coupling a second terminal of the first sub-loop to a positive terminal; and coupling a second terminal of the second sub-loop to a negative terminal.

18. The method of claim 17, further comprising:

disposing a first switch at the first modulating coil, wherein a first terminal of the first switch is coupled to a first terminal of the first modulating coil, a second terminal of the first switch is coupled to a second terminal of the first modulating coil;

disposing a third modulating coil, electrically isolated from the first modulating coil and the second modulating coil, above the first sub-loop; and disposing a second switch at the third modulating coil, wherein a first terminal of the second switch is coupled to a first terminal of the third modulating coil, a second terminal of the second switch is coupled to a second terminal of the third modulating coil.

19. The method of claim 18, further comprising:

disposing a third switch at the second modulating coil, wherein a first terminal of the third switch is coupled to a first terminal of the second modulating coil, a second terminal of the third switch is coupled to a second terminal of the second modulating coil, wherein the first switch, the second switch and the third switch are separated from each other.

20. The method of claim 19, further comprising:

forming a central tap on one of the first sub-loop and the second sub-loop, wherein a distance between the central tap and the first modulating coil is same as a distance between the central tap and the second modulating coil.

* * * * *